US006079637A

United States Patent [19]

Ohayon

[11] Patent Number: 6,079,637

[45] Date of Patent: Jun. 27, 2000

[54] AUTOMATIC ADJUSTABLE SPRINKLER FOR PRECISION IRRIGATION

[76] Inventor: Shalom Ohayon, 2305 60th St., Brooklyn, N.Y. 11024

[21] Appl. No.: 09/012,678

[22] Filed: Jan. 23, 1998

Related U.S. Application Data

[63] Continuation-in-part of application No. 08/691,343, Aug. 2, 1996, abandoned.

[51] Int. Cl.[7] ..... B05B 3/02

[52] U.S. Cl. ..... 239/236; 239/225.1; 239/DIG. 1

[58] Field of Search ..... 239/225.1, 230, 239/236, DIG. 1

[56] References Cited

U.S. PATENT DOCUMENTS

| | | | |
|---|---|---|---|
| 2,582,158 | 1/1952 | Porter | 239/236 X |
| 3,391,868 | 7/1968 | Cooney | 239/236 X |
| 3,451,623 | 6/1969 | Dibrell | 239/236 X |
| 3,952,954 | 4/1976 | Taylor | 239/236 |
| 3,960,327 | 6/1976 | Olson | 239/236 |
| 4,198,001 | 4/1980 | Rodriguez | 239/236 X |
| 4,613,077 | 9/1986 | Aronson | 239/236 X |
| 4,637,549 | 1/1987 | Schwartzman | 239/236 X |

FOREIGN PATENT DOCUMENTS

| | | | |
|---|---|---|---|
| 93509 | 1/1959 | Norway | 239/236 |

*Primary Examiner*—Lesley D. Morris

[57] ABSTRACT

A sprinkler for irrigating an area having a shape with an irrigating liquid includes a base; an inlet disposed on the base for receiving the irrigating liquid from a source; and a nozzle having a central axis, the nozzle being rotatably coupled to the base about the central axis and operatively coupled with the inlet to receive the irrigating liquid, the nozzle being adapted to spray the irrigating liquid out onto the area. The sprinkler also includes an adjustable valve operatively coupled between the inlet and the nozzle for controlling a flow rate of the irrigating liquid through the nozzle; a plate being coupled to and rotatable with the nozzle and having a plate axis which is co-axial with the central axis, the plate including a cam surface having a contour which corresponds with the shape of the area; and a lever element having a cam engaging element which engages the cam surface, the lever element being operatively coupled to the valve such that the contour of the cam surface causes the valve to control the flow rate of the irrigating liquid.

12 Claims, 7 Drawing Sheets

AUTOMATIC ADJUSTABLE SPRINKLER FOR PRECISION IRRIGATION

This application is a continuation in part of Ser. No. 08/691,343 filed Aug. 2, 1996 now abandoned.

BACKGROUND OF THE INVENTION

1. Field of the Invention

The present invention relates to adjustable sprinklers used for irrigation and, more particularly, to adjustable sprinklers for precision irrigation which use a mechanically preprogrammed disk for changing water flow within the sprinkler to attain precision irrigation.

2. Related Art

There are various types of sprinklers used for irrigating gardens, farms, lawns, or the like. Some such sprinklers utilize a rotating element which is spring-loaded and reacts to water emitting from a nozzle by bouncing away from the stream of water, thereby causing a counter weight to rotate the nozzle. This process is repeated such that the nozzle rotates in a 360° pattern and irrigation of a substantially round area of land is obtained.

These rotating sprinklers may be adjusted to rotate through only an arc and thereby irrigate only a sector of circle.

Although such rotating sprinklers have partial adjustability, they are very limited as to the shapes of the areas for which they can achieve precision irrigation. Indeed, these rotating sprinklers can only be programmed to irrigate a circular region or sector of a circular region.

Unfortunately, these prior art rotating sprinklers waste a large amount of water when used to irrigate non-circular areas due to over-spraying the non-circular areas. This is a particularly undesirable result in regions suffering from drought.

Further, over-spraying may inconvenience pedestrians attempting to walk in the area over-sprayed. Indeed, when land owners are irrigating lawns or the like, nearby sidewalks may be subject to over-spray from a rotating sprinkler. Pedestrians attempting to traverse a wet area of a sidewalk (or other area) may be inadvertently drenched with water or may slip and fall on slippery surfaces caused by the over-spray. Further, such pedestrians may be at risk from being hit by passing automobiles if they attempt to leave the sidewalk and walk along the street to avoid the over-spray.

Further, over-spray may also interfere with nearby electric lines causing shock hazards to passers by and/or users of the sprinkler.

Accordingly, there is a need in the art for an automatic adjustable sprinkler for precision irrigation which can cover areas of many different shapes without over-spray.

SUMMARY OF THE INVENTION

In order to overcome the disadvantages of the prior art, the sprinkler of the present invention is capable of irrigating an area of substantially any shape with an irrigating liquid. The sprinkler includes a base and an inlet disposed on the base for receiving the irrigating liquid from a source. The sprinkler also includes a nozzle having a central axis, the nozzle being rotatably coupled to the base about the central axis and operatively coupled with the inlet to receive the irrigating liquid, the nozzle being adapted to spray the irrigating liquid out onto the area. The sprinkler further includes an adjustable valve operatively coupled between the inlet and the nozzle for controlling a flow rate of the irrigating liquid through the nozzle and a plate being coupled to and rotatable with the nozzle and having a plate axis which is co-axial with the central axis, the plate including a cam surface having a contour which corresponds with the shape of the area. The sprinkler also includes a lever element having a cam engaging element which engages the cam surface, the lever element being operatively coupled to the valve such that the contour of the cam surface causes the valve to control the flow rate of the irrigating liquid.

Other features and advantages will become apparent to those skilled in the art from the following description of the invention which refers to the accompanying drawings.

BRIEF DESCRIPTION OF THE DRAWINGS

For the purpose of illustrating the invention, there are shown in the drawings forms which are presently preferred, it being understood, however, that the invention is not limited to the precise arrangements and instrumentalities shown.

DETAILED DESCRIPTION OF THE PREFERRED EMBODIMENTS OF THE PRESENT INVENTION

Figure 1:
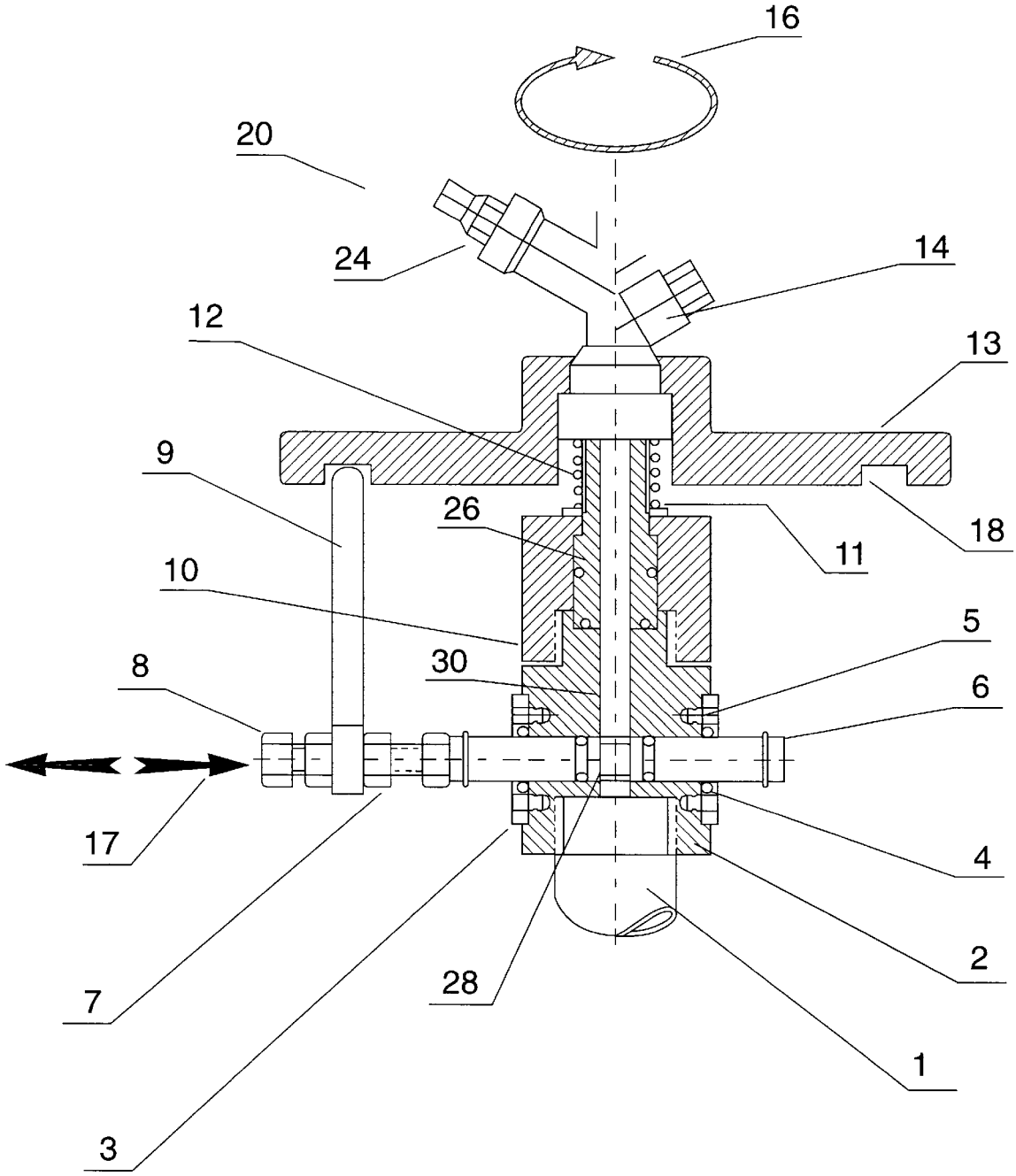
FIG. 1 is a side sectional view of an automatic sprinkler in accordance with the present invention.

Referring to the Figures wherein like numerals indicate like elements, there is shown in FIG. 1 an automatic adjustable sprinkler 20 in accordance with a first embodiment of the present invention. Automatic sprinkler 20 includes a nozzle 24 for directing a flow of irrigation liquid (preferably water) to an area to be irrigated (not shown). The adjustable sprinkler 20 also includes a means for rotating the nozzle 24 which is capable of rotating the nozzle 24 360°, denotated by numeral 16.

The automatic adjustable sprinkler 20 includes a water feed pipe (or water inlet) 1 which communicates with a pilot 2. Pilot 2 is coupled to a shaft 26 by way of an appropriate coupling means, such as a nut 10. Shaft 26 is coupled to the nozzle 24.

A valve 28 communicates with the water feed pipe 1 and a substantially central tube 30, which tube 30 extends from the valve 28 through the shaft 26 to the nozzle 24. Valve 28 is adapted to regulate the flow of water therethrough in a predetermined fashion as will be discussed in more detail below.

Figure 2:
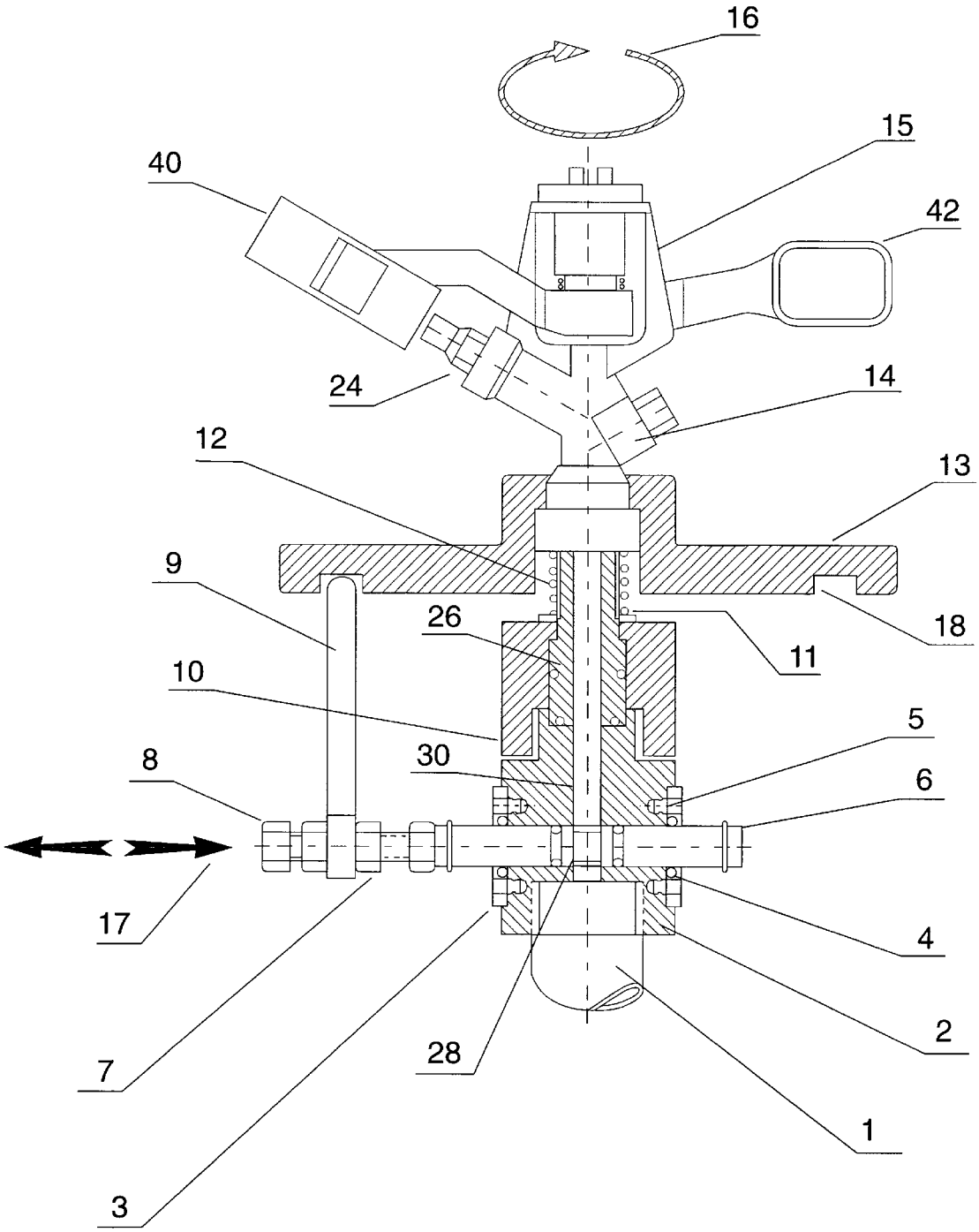
FIG. 2 is another side sectional view of the automatic sprinkler of FIG. 1 which also includes a sprinkler rotating element.

With reference to FIG. 2, an apparatus suitable for use as the sprinkler rotating element 15 is shown. The sprinkler rotating element includes a paddle 40 and a counterweight 42 which are centrally journalled on the nozzle 24. When water emitting from the nozzle 24 strikes the paddle 40, the paddle 40 rotates in the direction shown by arrow 16 which rotates counterweight 40 in a likewise fashion. Counterweight 42 causes the nozzle 24 to rotate by an incremental amount. This process is repeated and may cause nozzle 24 to rotate by 360°.

Pilot 2 includes a channel which slidably receives a plunger 6. Preferably, the plunger 6 is cylindrical and slidably moves within the pilot 2 as shown by arrow 17. Plunger 6 is operatively coupled to the valve 28 so that when the plunger 6 is moved in and out of the pilot 2, the amount of water flow through the valve is either increased or decreased.

Plunger 6 is sealably retained in the pilot 2 by way of o-rings which prevent water leaks from the valve 28 through the pilot 2. O-rings 4 are retained by securing washers 3 and screws 5.

A mechanically programmable plate 13 is operatively coupled to and rotates with the nozzle 24. Nozzle 24 and programmable plate 13 are rotatably coupled to shaft 26, preferably by a swivel disk 11 and spring 12.

A lower surface of programmable plate 13 includes a grooved channel 18 which is sized to receive one end of a lever 9. The other end of lever 9 is coupled to the plunger 6 using a suitable coupling technique. Preferably, the lever 9 is coupled to the plunger 6 by way of adjusting nut 8 and nut 7. It is preferred that lever 9 is fixedly coupled to plunger 6 such that both plunger 6 and lever 9 move radially with respect to pilot 2.

The one end of lever 9 is slidably received in grooved channel 18 such that lever 9 is caused to move radially with respect to pilot 2 in response to a radial position of grooved channel 18 with respect to a central axis of programmable plate 13. Consequently, as nozzle 24 and programmable plate 13 rotate in the direction shown by arrow 16, lever 9 moves toward or away from pilot 2 thereby causing plunger 6 to move into and away from pilot 2 in the direction shown by arrow 17. The opening and closing of valve 28 is responsive to the radial position of grooved channel 18 with respect to the central axis of programmable plate 13 and, therefore, the distance which water emitting from the nozzle 24 reaches is programmable in response to the positioning of grooved channel 18.

As will be apparent to those skilled in the art from the above teaching, the grooved channel 18 may be replaced with a rib or flange extending from the bottom surface of the programmable plate 13. In such a case, the lever 9 would include a receiving channel (not shown) for slidably engaging the rib or flange. Of course, many other modifications and/or various will be apparent to those skilled in the art from the above.

Figure 3:
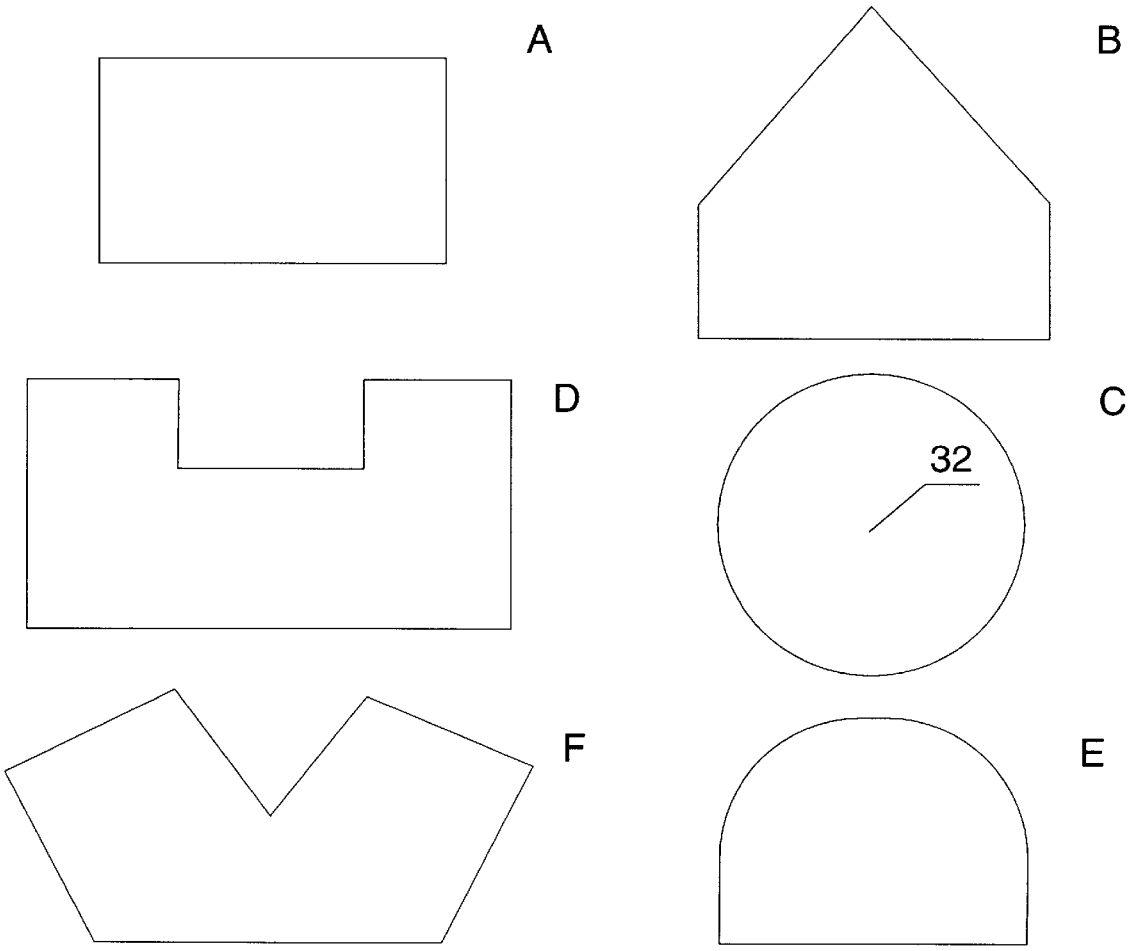
FIG. 3 shows a sample of shapes that a sprinkler in accordance with the present invention may cover.

Reference is now made to FIG. 3 which shows a sample of shaped areas that the adjustable sprinkler 20 may irrigate with precision. Mechanically programmable plate 13 is provided with the grooved channel 18 having a radial distance from the center of the plate 13 which varies in accordance with the perimeter of the area being irrigated. For example, in order to precisely irrigate an area having a shape designated as C (FIG. 3), the grooved channel 18 would have a radial distance from the center of the programmable plate 13 which is substantially constant when the adjustable sprinkler 20 is at position 32.

It is apparent to those skilled in the art that the sprinkler 20 may be placed anywhere within the perimeter of the area to be irrigated so long as the radial distance of the grooved channel 18 with respect to the center of the programmable plate 13 is suitably adjusted.

Figure 4:
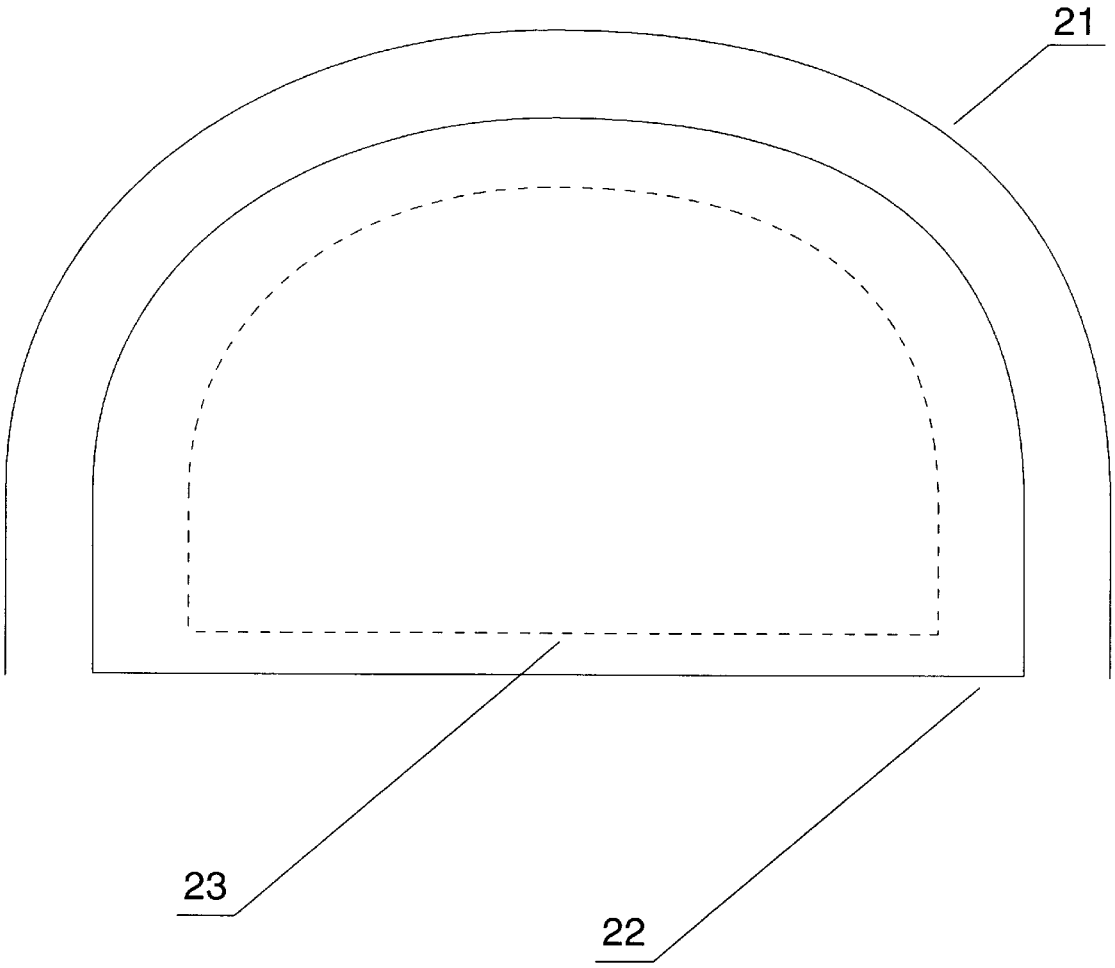
FIG. 4 shows another shape of an area that a sprinkler in accordance with the present invention may cover.

Referring to FIG. 4, the adjustable sprinkler 20 may be employed to irrigate a desired area 23 within a fenced area 22 (for example, a garden) without over-spraying a sidewalk 21 located near the fenced area 22.

Figure 5:
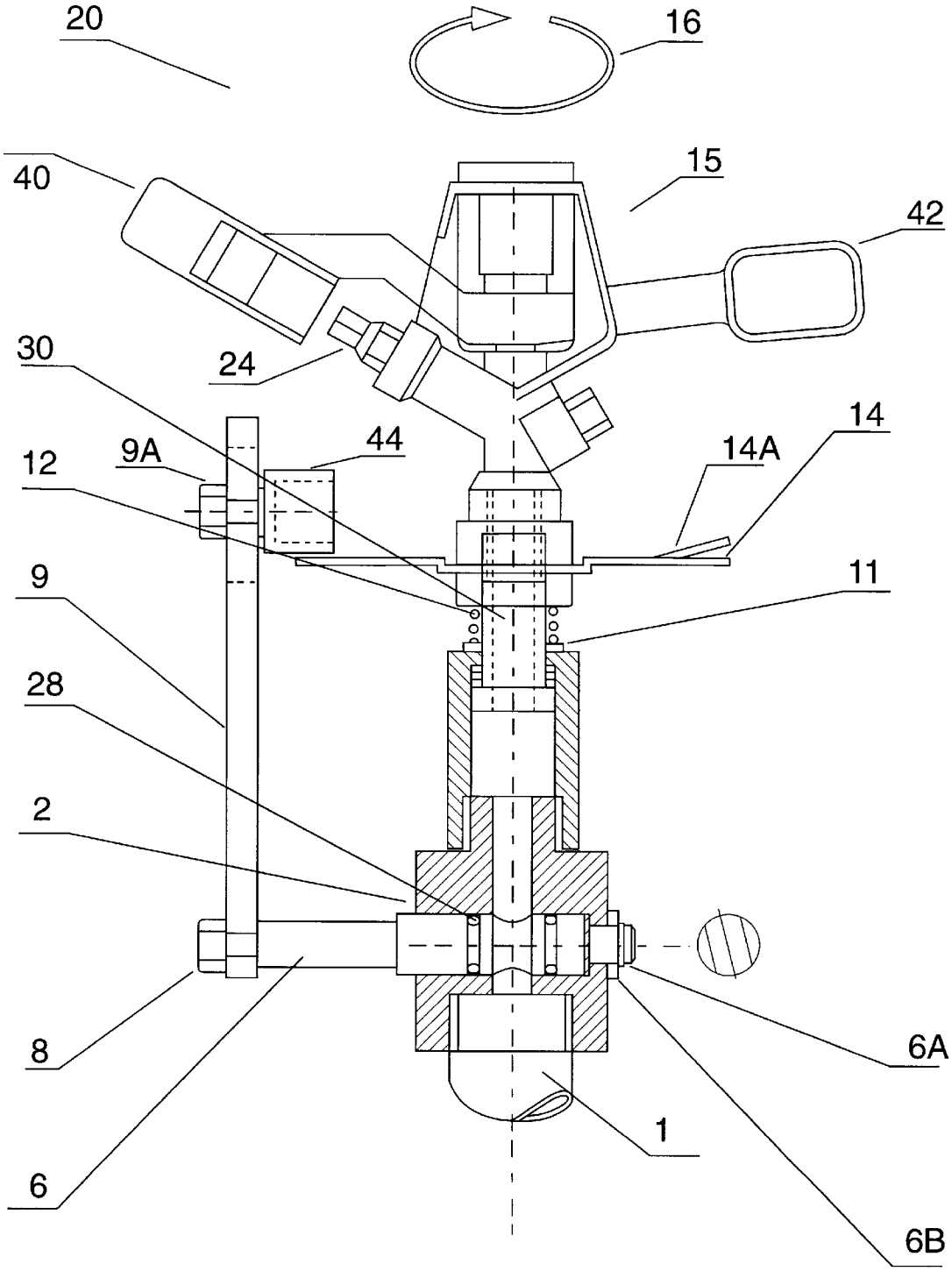
FIG. 5 shows a side sectional view of an automatic sprinkler according to an alternative embodiment of the present invention.

Reference is now made to FIG. 5 which shows an automatic adjustable sprinkler 20 in accordance with an alternative embodiment of the present invention. The primary difference between the sprinkler 20 of FIG. 5 and the sprinkler of FIG. 1 is the technique by which the programmability of the mechanical programming plate affects the opening and closing of the valve 28.

Figure 7B:
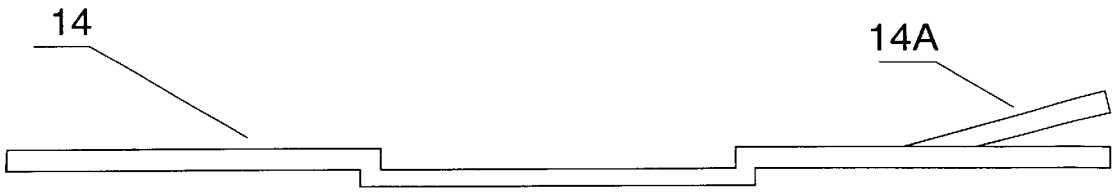
FIG. 7B is a side view of the mechanically programmable disk of FIG. 7A.
Figure 7A:
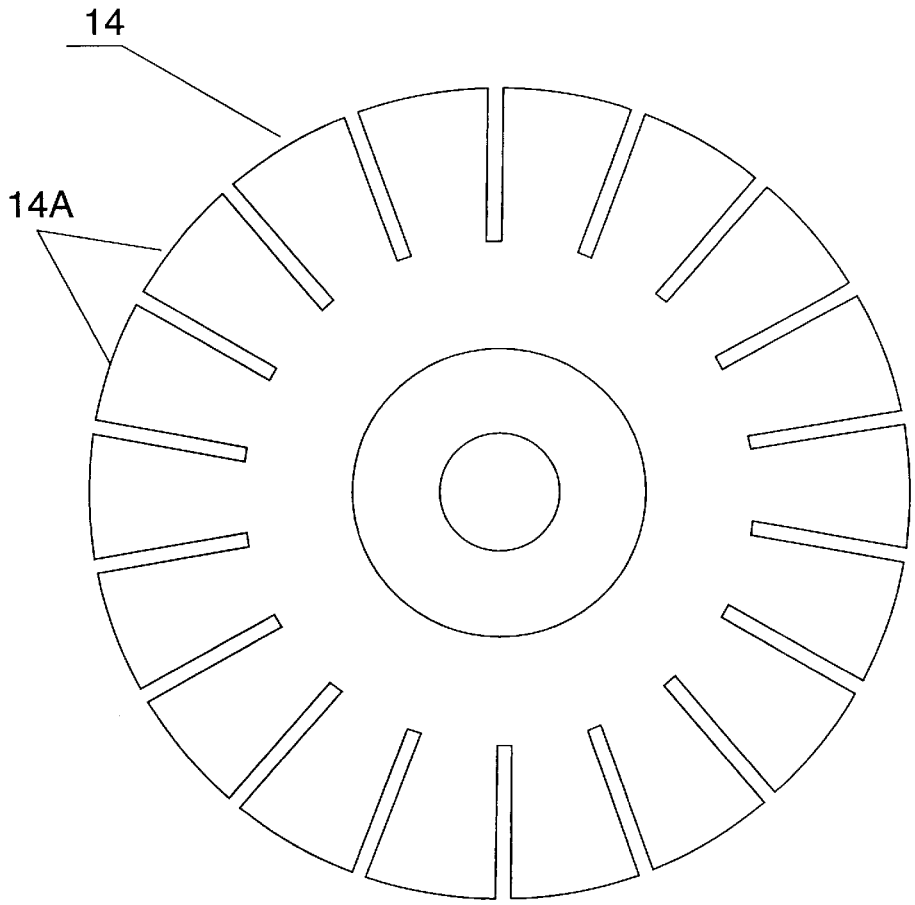
FIG. 7A shows a top view of a mechanically programmable disk for the sprinkler of FIG. 5.

With reference to FIGS. 7A and 7B, the mechanically programmable plate 14 in accordance with this embodiment of the present invention employs a plurality of bendable elements (preferably fin-shaped) 14A which may be manipulated manually. Programmable plate 14 preferably includes a plurality of circumferentially disposed fins 14A which extend radially from a central portion of the plate 14. Preferably, the plate 14 is substantially disk shaped. Fins 14A are adapted to be bent upward and out of the general plane of the plate 14 (FIG. 7B). As will be discussed in more detail below. The location of and the degree to which a particular fin 14A is bent affects the flow of water through the valve 28.

Programmable plate 14 may be made from any of the known materials, where materials that may be readily bent are most preferred. It is preferred that the plate 14 be formed of a material which allows fins 14A to be readily bent from or returned to the plane of the plate 14.

Figure 6:
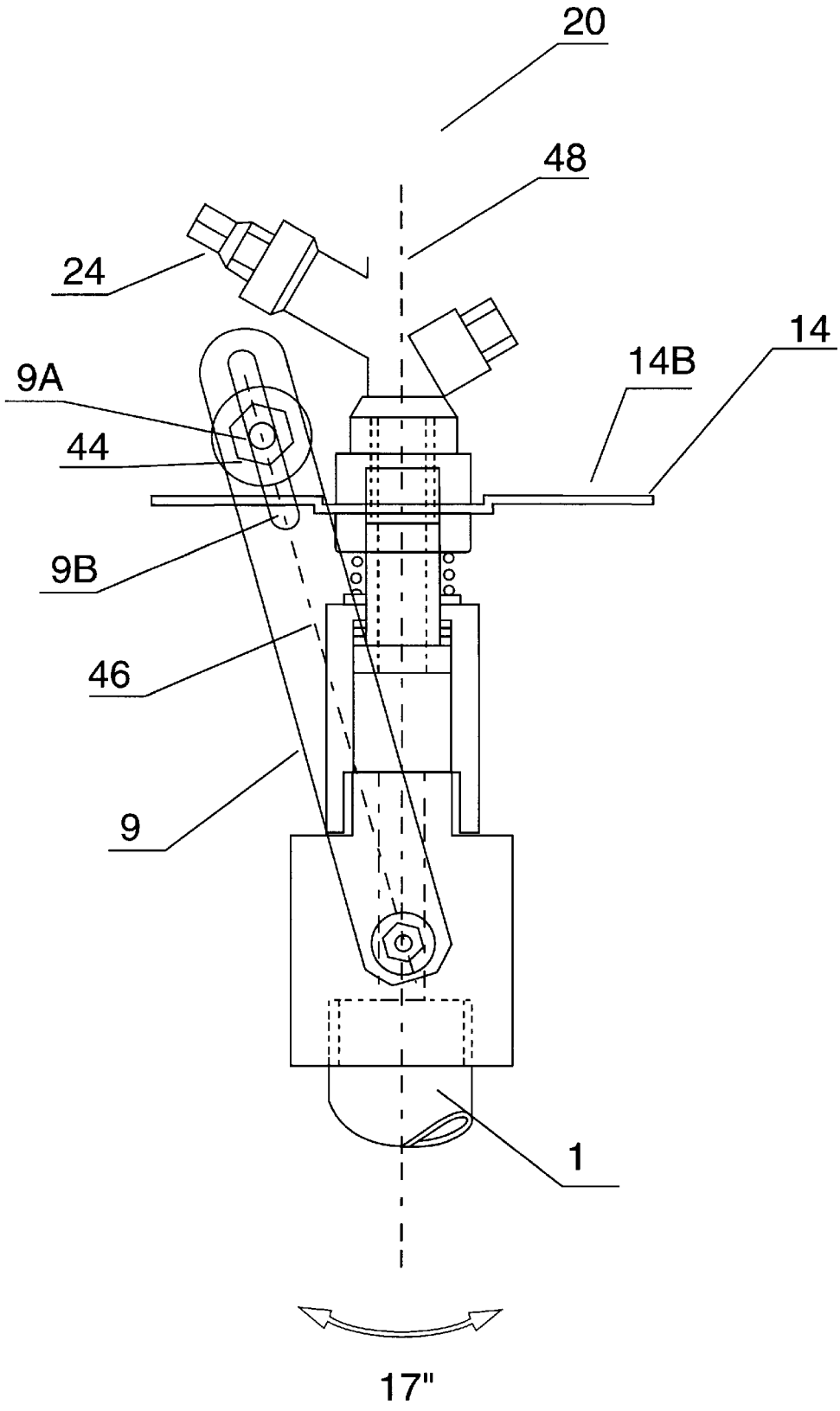
FIG. 6 shows another side view of the automatic sprinkler of FIG. 5.

With reference to FIGS. 5 and 6, the valve 28 is opened and closed by rotating the plunger 6 as shown by arrow 17'. Plunger 6 is rotated by moving lever 9.

One end of lever 9 includes a roller 44 which is preferably rotatably coupled to lever 9 via adjusting nut 9A. As best seen in FIG. 6, roller 44 rolls along the top surface 14B of programmable plate 14. When roller 44 comes into contact with a bent fin 14A, lever 9 rotates thereby causing plunger 6 to open or close valve 28. Accordingly, one or more fins 14A may be bent upward and out of the plane of the plate 14 in order to change the flow characteristics of the water out of the nozzle 24.

With reference to FIG. 6, a longitudinal axis 46 of the lever 9 is not substantially parallel with a central axis 48 of the nozzle 24. It is preferred that the lever 9 be biased such that the lever 9 is rotated and longitudinal axis 46 is not parallel with the central axis 48. Thus, the roller 44 is biased into engagement with the top surface 14B (i.e., the cam surface) of programmable plate 14.

As the fins 14A, which are bent out of the plane of programmable plate 14 engage the roller 44, the lever 9 rotates in a direction such that the longitudinal axis 46 approaches a parallel orientation with respect to central axis 48. The degree to which the fins 14A are bent out of the plane of programmable plate 14 affects the degree to which the longitudinal axis 46 approaches the parallel orientation with respect to central axis 48. Indeed, as a bent fin 14A causes lever 9 to rotate, roller 44 begins to elevate above the plane of programmable plate 14, thereby permitting a bent fin 14A to pass under the roller 44. Consequently, fins 14A which are bent relatively far out of the plane of programmable plate 14 will cause lever 9 to rotate to a higher degree and cause longitudinal axis 46 to approach a substantially parallel orientation with respect to central axis 48.

It is preferred that lever 9 be rotatably biased such that longitudinal axis 46 is not substantially parallel with central axis 48 and roller 44 is engaged with the top surface 14B of programmable plate 14 by way of the flow of water through the valve 28.

With reference to FIG. 6, roller 44 may be adjusted along the length of the lever 9 by way of adjusting nut 9A. In particular, roller 44 may be slid along slot 9B within lever 9 and fixed via adjusting nut 9A.

It has been found that the frictional losses between roller 44 and the programmable plate 14 are greatly reduced over the frictional losses between lever 9 and grooved channel 18 of FIG. 1. Accordingly, some improvement in performance is achieved using the embodiment of FIGS. 5 and 6 over the embodiment of FIG. 1.

With reference to FIGS. 1 and 5, it is noted that programmable plate 13 and programmable plate 14 are co-axially coupled with the nozzle 24. Advantageously, this configuration results in relatively few required parts and consequently lower costs.

As will be apparent to those skilled in the art, the automatic adjustable sprinkler 20 of FIG. 5 may be utilized to irrigate the areas shown in FIG. 3 with precision as was the case with the sprinkler of FIG. 1.

As is apparent to those skilled in the art, the programmable plates 13, 14 of the sprinklers 20 shown in FIGS. 1 and 5, respectively, include a cam surface which is engaged by a cam engaging element. In particular, the grooved channel 18 of programmable plate 13 is a cam surface which is engaged by one end of the lever 9 (the cam engaging element). Similarly, the upper surface 14B of programmable plate 14 (FIG. 6) is a cam surface which receives the roller 44 (a cam engaging element). The shape of the cam surface of the programmable plates 13, 14 is shaped such that the opening and closing of the valve 28 will correspond with the shape of the area to be irrigated (FIG. 3).

The foregoing description of the preferred embodiments of the present invention has been provided for the purposes of illustration and description. It is not intended to be exhaustive or to limit the invention to the precise forms disclosed. Many modifications and variations are possible in light of the above teaching. It is intended that the scope of the invention be limited not by this detailed description, but rather by the claims appended hereto.

I claim:

1. A sprinkler for irrigating an area having a shape with an irrigating liquid, comprising:

a base;

an inlet disposed on the base for receiving the irrigating liquid from a source;

a nozzle having a central axis, the nozzle being rotatably coupled to the base about the central axis and operatively coupled with the inlet to receive the irrigating liquid, the nozzle being adapted to spray the irrigating liquid out onto the area;

an adjustable valve operatively coupled between the inlet and the nozzle for controlling a flow rate of the irrigating liquid through the nozzle;

a plate being coupled to and rotatable with the nozzle and having a plate axis which is co-axial with the central axis, the plate including a cam surface having a contour which corresponds with the shape of the area the cam surface including a grooved channel having a radial distance from the plate axis which causes the valve to control the flow rate of the irrigating liquid as the plate rotates;

a lever element having a cam engaging element which is slidably engaged with the grooved channel of the plate such that the radial distance of the grooved channel from the plate axis is transferred to the value to control the flow rate of the irrigating liquid, the lever element being operatively coupled to the value such that the contour of the cam surface causes the value to control the flow rate of the irrigating liquid; and a plunging element coupled to the lever element and adapted to move radially with respect to the plate axis of the plate into and out of the base in response to the lever element, the plunging element being coupled to the value to control the flow rate of the irrigating liquid, wherein the lever is adjustable coupled to the plunger for adjusting the flow rate of the irrigating liquid through the valve.

2. The sprinkler of claim 1, wherein the area includes a perimeter defining a shape and the radial distance of the grooved channel from the plate axis corresponds to the shape.

3. The sprinkler of claim 1, wherein the plate includes a lower surface, the grooved channel being disposed on the lower surface.

4. The sprinkler of claim 1, wherein the irrigating liquid is water.

5. The sprinkler of claim 1, wherein:

the plate lies substantially in a plane perpendicular to the plate axis, the plate including a plurality of bendable elements located at a plurality of angular positions about the plate axis and adapted to bend out of the plane to form the cam surface; and the angular positions of the bendable elements which are bent out of the plane cause the valve to control the flow rate of the irrigating liquid as the plate rotates.

6. The sprinkler of claim 5, wherein the area includes a perimeter defining a shape and the angular positions of the bendable elements correspond to the shape.

7. The sprinkler of claim 5, wherein the area includes a perimeter defining a shape and respective amounts that the bendable elements are bent out of the plane correspond to the shape.

8. The sprinkler of claim 5, wherein the cam engaging element of the lever element includes a roller which is rollably engaged with the bendable elements of the plate such that the angular positions of the bendable elements and respective amounts that the bendable elements are bent out of the plane are transferred to the valve to control the flow rate of the irrigating liquid.

9. The sprinkler of claim 8, further including a pivot element coupled to the lever element and adapted to rotate in response to the lever element, the pivot element being coupled to the valve to control the flow rate of the irrigating liquid.

10. The sprinkler of claim 9, wherein respective amounts that the bendable elements are bent out of the plane effect a degree to which the pivot element rotates and a degree to which the valve affects the flow rate of the irrigating liquid.

11. The sprinkler of claim 10, wherein the lever element has an longitudinal axis, the lever being rotatably biased such that the longitudinal axis is not substantially parallel with the plate axis.

12. The sprinkler of claim 11, wherein the respective amounts that the bendable elements are bent out of the plane effect the degree to which the longitudinal axis approaches or reaches parallel with the plate axis and the degree to which the valve affects the flow rate of the irrigating liquid.

* * * * *